US007841403B2

(12) United States Patent
Minto et al.

(10) Patent No.: US 7,841,403 B2
(45) Date of Patent: Nov. 30, 2010

(54) ROTATOR FOR WIRELINE CONVEYED WELLBORE INSTRUMENTS AND METHOD FOR ROTATING AN INSTRUMENT IN A WELLBORE

(75) Inventors: James Minto, Houston, TX (US); Bruce P Marion, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 12/117,400

(22) Filed: May 8, 2008

(65) Prior Publication Data

US 2009/0277631 A1 Nov. 12, 2009

(51) Int. Cl.
*E21B 47/09* (2006.01)

(52) U.S. Cl. ..... 166/255.2; 166/66.5

(58) Field of Classification Search ..... 166/255.2, 166/381, 66.5
See application file for complete search history.

(56) References Cited

U.S. PATENT DOCUMENTS 2,015,401 A * 9/1935 Jakosky ..... 324/360
3,105,546 A * 10/1963 Ownby et al. ..... 175/4.51
3,182,724 A 5/1965 Shore
3,191,144 A * 6/1965 Pardue ..... 367/25
3,258,963 A * 7/1966 Bryant et al. ..... 73/152.35
3,288,210 A * 11/1966 Bryant ..... 166/254.1
3,307,626 A 3/1967 Bielstein
3,406,766 A * 10/1968 Henderson ..... 175/61
3,614,891 A * 10/1971 Nolte ..... 73/152.15
3,964,553 A * 6/1976 Basham et al. ..... 175/4.51
2002/0066568 A1 6/2002 Buchanan et al.
2005/0133220 A1 6/2005 Bishop
2005/0241824 A1 11/2005 Burris, II et al.

FOREIGN PATENT DOCUMENTS

GB 2094484 9/1982

* cited by examiner

*Primary Examiner*—Daniel P Stephenson
(74) *Attorney, Agent, or Firm*—Jonna Flores; Darla Fonsec; Charlotte Rutherford

(57) ABSTRACT

An apparatus for rotating an instrument in a wellbore includes a non magnetic housing configured to traverse the interior of the wellbore. The housing has an external diameter smaller than an internal diameter of a casing disposed in the wellbore. A plurality of electromagnets is arranged circumferentially about the interior of the housing and is configured to induce magnetic flux through a wall of the housing when actuated. A controller configured to sequentially rotationally actuate the electromagnets. A method for rotating a wellbore instrument in a wellbore includes causing parts of an instrument housing to be sequentially rotationally magnetically attracted to a casing disposed in the wellbore. The housing has a smaller external diameter than an internal diameter of the casing. The sequential rotational magnetic attraction is continued as needed.

9 Claims, 3 Drawing Sheets

ROTATOR FOR WIRELINE CONVEYED WELLBORE INSTRUMENTS AND METHOD FOR ROTATING AN INSTRUMENT IN A WELLBORE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The invention relates generally to the field of instruments conveyed into subsurface wellbores by armored electrical cable. More specifically, the invention relates to devices for moving such instruments to a selected rotary orientation within a wellbore.

2. Background Art

Many types of instruments are used in wellbores drilled through subsurface rock formations. Such instruments can include, among other devices, sensors for measuring properties of the rock formations outside the wellbore, energy sources for various types of surveying or evaluation, mechanical wellbore intervention tools and directional survey instruments, as non limiting examples. Such instruments may be conveyed along the inside of the wellbore by a technique generally known as "wireline" in which an armored cable having one or more insulated electrical conductors therein is extended into and withdrawn from the wellbore using a winch, and in which the instruments are disposed at the end of the cable.

In some cases, it may be desirable to move the instrument to a selected rotary orientation within the wellbore. Such orientations may include having sensors on the instrument directed toward, for example, the gravitationally upwardmost direction ("high side") for purposes of surveying the trajectory of the wellbore. Other examples may include having a seismic energy source oriented in the direction of an adjacent wellbore.

Irrespective of the reason for requiring rotary orientation capability, it has proven impractical to provide such capability when instruments are conveyed into a wellbore by wireline.

SUMMARY OF THE INVENTION

A method for rotating a wellbore instrument in a wellbore according to one aspect of the invention includes causing parts of an instrument housing to be sequentially rotationally magnetically attracted to a casing disposed in the wellbore. The housing has a smaller external diameter than an internal diameter of the casing. The sequential rotational magnetic attraction is continued until the instrument housing is oriented in a selected rotational direction.

An apparatus for rotating an instrument in a wellbore according to another aspect of the invention includes a non magnetic housing configured to traverse the interior of the wellbore. The housing has an external diameter smaller than an internal diameter of a casing disposed in the wellbore. A plurality of electromagnets is arranged circumferentially about the interior of the housing and is configured to induce magnetic flux through a wall of the housing when actuated. A controller configured to sequentially rotationally actuate the electromagnets.

Other aspects and advantages of the invention will be apparent from the following description and the appended claims.

DETAILED DESCRIPTION

Figure 1:
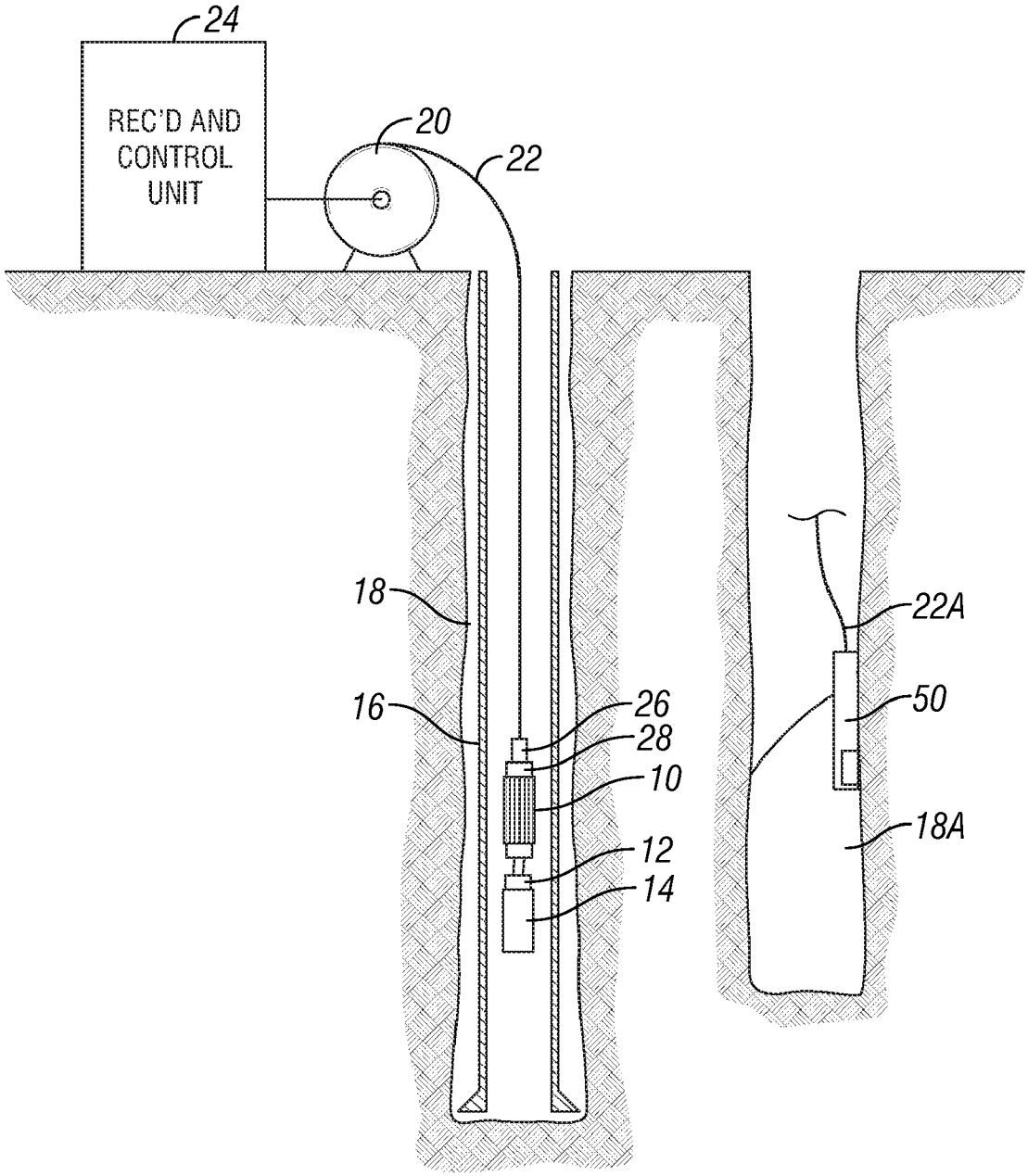
FIG. 1 shows an instrument conveyed into a wellbore as it may be used with an example rotator according to the invention.

FIG. 1 shows an instrument 14 conveyed into a wellbore 18 drilled through subsurface rock formations. The wellbore 18 in FIG. 1 includes a steel pipe or casing 16 installed therein. It is only necessary for purposes of using the invention that the casing 16 is ferromagnetic. Other properties of the casing 16 are not intended to limit the scope of the invention. The instrument 14 in the present example can be conveyed through the interior of the casing using armored cable 22 deployed by a winch 20. Such conveyance is known as "wireline" as explained in the Background section herein. The cable 22 may include one or more insulated electrical conductors for transmitting power to the instrument 14 and communicating signals from the instrument 14 to a recording and control unit 24 disposed at the surface. For purposes of defining the scope of the invention, other conveyance known in the art called "slickline" in which the cable has a cylindrical, smooth exterior surface and may or may not include electrical conductors therein is intended to be within the definition of "wireline." An example of slickline having electrical conductors therein is described in U.S. Pat. No. 5,122,209 issued to Moore.

The instrument 14 is coupled to the cable 22 using a cable head 26. The cable head 26 may be coupled to a swivel 28 that enables relative rotation between the cable 22 and the instrument 14 while maintaining electrical communication between the instrument 14 and the cable 22. The swivel 28 may be coupled to one end of a rotator 10. The other end of the rotator 10 may be coupled to the instrument 14, in some examples using a flexible coupling 12. The flexible coupling 12 may be used to enable the instrument 14 to be moved with respect to the rotator 10 by deflection and/or displacement of the axis of the instrument 14 with respect to the axis of the rotator 10, while maintaining rotational coupling between the instrument 14 and the rotator 10. See U.S. Pat. No. 5,808,191 issued to Alexy, Jr. et al. for a description of one example of a flexible coupling, although the type of flexible coupling and whether it is used in any example is not intended to limit the scope of the present invention.

It is also to be understood that the instrument 14 and the rotator 10 may be disposed within the same instrument housing or as part of the same instrument. The description with reference to and the illustration in FIG. 1 are meant only to provide one non limiting example of how to make and use the present invention. Accordingly, the use of a separate rotator and instrument as shown is not a limit on the scope of the present invention.

One example of a type of instrument that may be used with a rotator according to the invention is a directional seismic energy source. Such sources may direct a substantial portion of the seismic energy generated in a single lateral direction, or within a limited range of angle with respect to the source longitudinal axis of the source. In the example shown in FIG. 1, a seismic receiver 50 may be disposed in another wellbore 18A, and may be conveyed therein using a second wireline 22A. One example of such a seismic receiver is described in U.S. Pat. No. 4,715,469 issued to Yasuda et al. In such examples, the seismic energy source if disposed in the wellbore 18 may be rotationally oriented using the rotator 10 so that its signal output is directed toward the other wellbore 18A.

Figure 2:
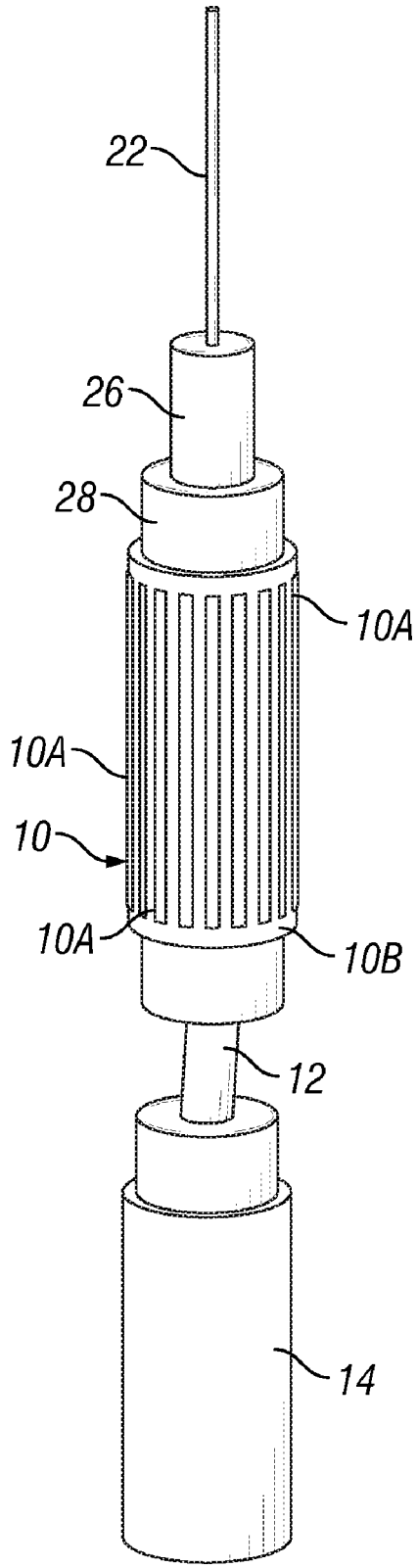
FIG. 2 shows the instrument, the example rotator and associated devices of FIG. 1 in more detail.

The instrument 14, flexible coupling 12, rotator 10 swivel 28 and cable head 26 are shown in more detail in FIG. 2. In particular, the rotator 10 may include a substantially cylindrical housing 10B formed from a non-magnetic material, for example, monel, stainless steel, titanium or an alloy sold under the trademark INCONEL, which is a registered trademark of Huntington Alloys Corporation, Huntington, W. Va. The housing 10B may include through the wall thereof a plurality of longitudinally extending, circumferentially spaced apart magnet pole shoes 10A. In other examples, depending on the material from which the housing 10B is made, its thickness and the amount of torque needed to be generated by the rotator 10 to rotate the instrument, the pole shoes 10A may not protrude through the wall of the housing 10B. As will be explained with reference to FIG. 3, each pole shoe may be associated with one or more electromagnets that may be actuated to cause the rotator 10 to be magnetically attracted to the casing (16 in FIG. 1). Sequential actuation of the electromagnets (FIG. 3) will cause rotation of the rotator 10 inside the casing (16 in FIG. 1). The rotator housing 10B may have an external diameter that is smaller than the internal diameter of the casing (16 in FIG. 1). Because of the diameter difference between the housing 10B and the casing, the magnetic rotation of the housing 10B in the casing will cause the housing 10B orientation to precess within the casing. That is, the rotational orientation of the housing 10B will move with respect to the casing as the housing rotates inside the casing in contact therewith. By continuing rotation, the housing 10B may eventually be oriented in a selected rotational orientation.

Figure 3:
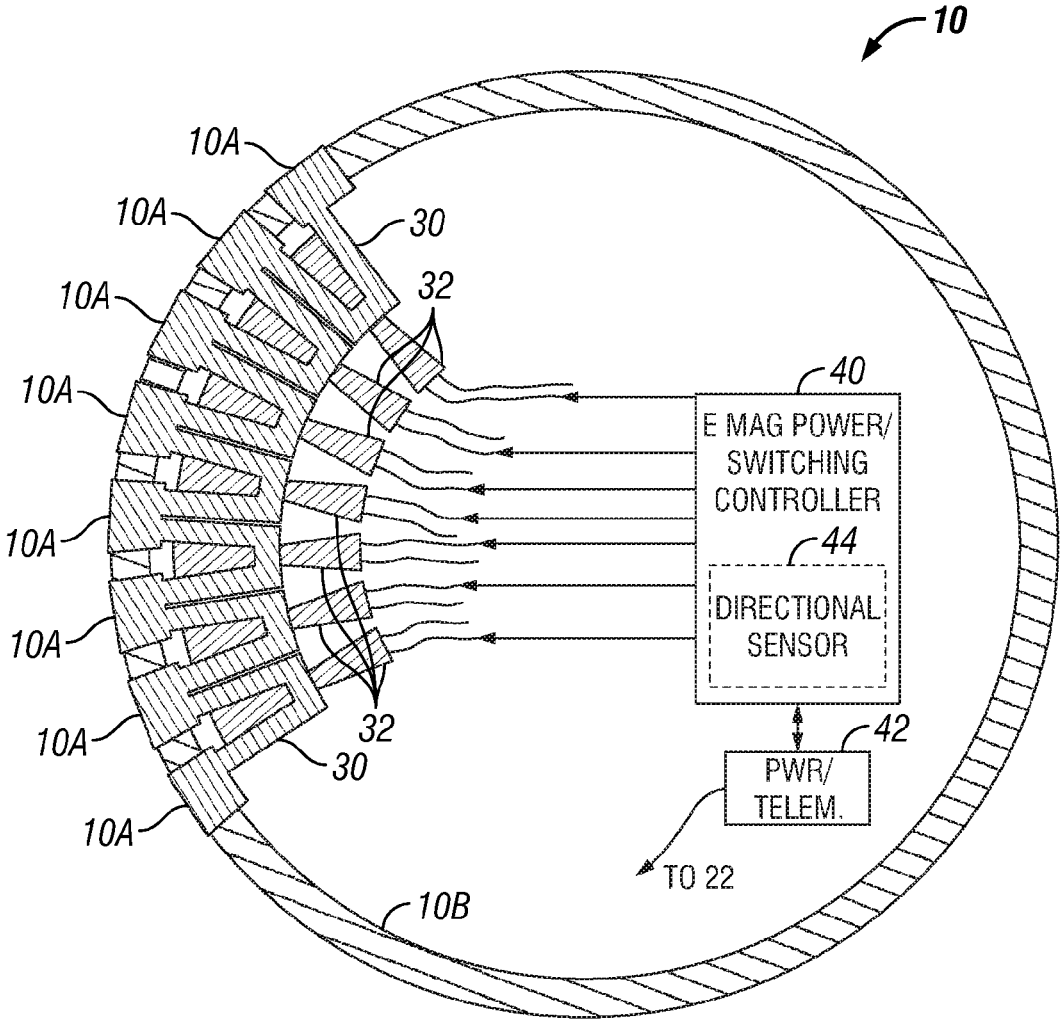
FIG. 3 shows a cross section of one example of a rotator.

An example structure for causing magnetic rotation of the rotator 10 within the casing (16 in FIG. 1) is shown in cross section in FIG. 3. The housing 10B may include a plurality of circumferentially spaced apart pole shoes 10A as explained above. The pole shoes 10A may be made from ferromagnetic material such as steel. Each pole shoe 10A may be associated with one pole of two adjacent ferromagnetic electromagnet cores 30. The cores 30 may extend longitudinally about the same distance as the pole shoes 10A and may have end section in approximately the shape of the letter "C" as shown in FIG. 3. An electromagnet wire coil 32 may be wound longitudinally around the center of each core 30 as shown in FIG. 3 such that the magnetic dipole of each coil 32 is substantially perpendicular to the plane of symmetry (not shown) of each core 30. The configuration shown in FIG. 3 may have the advantages of generating high magnetic attraction between the pole shoes 10A associated with the activated electromagnets (each electromagnet consisting of a coil 32 and a core 30), while minimizing magnetization of the other pole shoes 10A, because the C-shape of the core causes magnetic flux to flow in a closed magnetic circuit including the adjacent pole shoes 10A and the casing (16 in FIG. 1) in contact with the pole shoes 10A. Other configurations may include a separate pole shoe for each open end of each core. In principle, the structure of the cores, coils and pole shoes is intended to induce magnetic flux through the wall of the housing 10B when each coil is energized.

The coils 32 are each connected to a electromagnet switching controller 40 which may be any microprocessor based controller associated with suitable power switching circuitry (not shown separately) to apply electrical current to the coils 32 rotationally sequentially, thus causing rotation of the ones of the pole shoes 10A that are magnetically attracted to the casing (16 in FIG. 1). In the example of FIG. 3, the controller 40 may be in signal communication with a directional sensor 44 so that the rotational orientation of the rotator 10 (and the instrument connected thereto) with respect to a geodetic reference may be determined. It will be appreciated by those skilled in the art that because the rotator 10 is used in ferromagnetic casing, the directional sensor 44 must be of a type that is not dependent on the Earth's magnetic field to establish a geodetic reference. One non limiting example of such a directional sensor is described in U.S. Pat. No. 4,611,405 issued to Van Steenwyk, in which geodetic reference is established using an Earth rate gyroscope. In examples using cable having electrical conductors therein, electrical power and signals between the instrument (14 in FIG. 1) and the recording unit (24 in FIG. 1) may be transferred between the cable (22 in FIG. 1), the controller 40 and other devices by a power conditioner/telemetry device 42 of types well known in the art. The example shown in FIG. 3 in which the controller is disposed inside the rotator is only one example of a device for selectively applying current to the coils to cause the sequential actuation of the electromagnets. In other examples, an individual electrical conductor could be provided in the cable (22 in FIG. 2) for each coil 32. Any other configuration that enables selective actuation of the coils may be used consistent with the scope of this invention.

In using the rotator made as explained above, the coils 32 are rotationally sequentially energized, causing the pole shoes 10A to be rotationally sequentially attracted to the casing (16 in FIG. 1). Such rotational magnetic attraction causes the rotator 10 to precessionally rotate inside and to contact the interior of the casing. The difference between the internal diameter of the casing and the external diameter of the housing (or the pole shoes 10A if they are made to extend laterally outwardly from the housing) will determine the amount of precession of the rotational orientation of the rotator 10 with respect to the casing each time the rotator 10 completes a full rotation within the casing. Thus, it may be necessary to rotate the rotator through a number of full rotations inside the casing to provide a selected rotary orientation. In the example shown in FIG. 1 and FIG. 2, the swivel (28 in FIG. 1) may be used advantageously to enable the rotator to rotate as much as is required without twisting the cable (22 in FIG. 1). In some examples, rotation of the rotator 10 may be made smoother by controlling the current in each of the coils 32 so that magnetization is gradually reduced, while magnetization in the adjacent coil is gradually increased. In such examples, there may be current flowing in two or more adjacent coils at any time to optimize the rotation.

In other examples, the rotator may be used for substantially continuous rotation for a selected period of time, for example, to operate a drill, mill or grinding device for wellbore repair or intervention operations. It will be appreciated by those skilled in the art that by selection of a suitable rotator outer diameter for a particular casing internal diameter, the rotator may be provided with selected rotation speed and torque for the particular use intended. Larger rotator diameter will result in lower rotation speed and higher torque, and vice versa for smaller diameters.

A wellbore instrument rotator according to the invention may provide the capability of moving an instrument conveyed along a wellbore by a cable to any selected rotary orientation without the need to rotationally fix any part of the instrument within the wellbore.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for rotating a wellbore instrument in a wellbore, comprising:

causing parts of an instrument housing to be sequentially rotationally magnetically clamped to a casing disposed in the wellbore, wherein the housing has a smaller external diameter than an internal diameter of the casing; and continuing to cause parts of the instrument housing to be sequentially rotationally magnetic clamped until the instrument housing is clamped and oriented in a selected rotational direction, thereby rolling the instrument housing around the interior of the casing through at least a plurality of positions while the instrument housing remains magnetically clamped to the casing.

2. The method of claim 1 wherein the causing parts of the instrument housing to be sequentially rotationally magnetically clamped comprises sequential actuation of a plurality of electromagnets arranged such that actuation thereof induces magnetic attraction between an associated portion of the housing and the casing.

3. The method of claim 1 wherein the selected rotational orientation is determined by measuring an orientation of the housing with respect to a geodetic reference.

4. The method of claim 3 wherein the geodetic reference is determined by measurement of Earth's rotation rate in the instrument.

5. An apparatus for rotating an instrument in a wellbore, comprising:

a non magnetic housing configured to traverse the interior of the wellbore, the housing having an external diameter smaller than an internal diameter of a casing disposed in the wellbore;

a plurality of electromagnets arranged circumferentially about the interior of the housing and configured to induce magnetic flux through a wall of the housing when actuated and wherein the magnetic flux causes the housing to magnetically clamp to the casing disposed in the wellbore; and a controller configured to sequentially rotationally actuate the electromagnets, and thereby roll the non magnetic housing around the interior of the casing through at least a plurality of positions while the non magnetic housing remains magnetically clamped to the casing.

6. The apparatus of claim 5 wherein each electromagnet comprises a substantially C-shaped core and a wire coil wound around the core.

7. The apparatus of claim 5 wherein each electromagnet comprises a pole shoe proximate each pole end of each electromagnet, the pole shoe passing through the wall of the housing.

8. The apparatus of claim 5 further comprising a directional sensor configured to measure an orientation of the housing with respect to a geodetic reference.

9. A method for rotating a wellbore instrument in a wellbore, comprising:

causing parts of an instrument housing to be sequentially rotationally magnetically clamped to a casing disposed in the wellbore, wherein the housing has a smaller external diameter than an internal diameter of the casing;

continuing to cause parts of the instrument housing to be sequentially rotationally magnetically clamped to cause the instrument housing to rotate for a selected time; and rolling the instrument housing around the interior of the casing through at least a plurality of positions while the instrument housing remains magnetically clamped to the casing.

* * * * *